United States Patent [19]

Ishizawa et al.

[11] Patent Number: 4,622,823

[45] Date of Patent: Nov. 18, 1986

[54] GAS REFRIGERATOR

[75] Inventors: Tadao Ishizawa; Hirofumi Kotaka; Masami Kakinuma, all of Narashino, Japan

[73] Assignee: Seiko Seiki Kabushiki Kaisha, Chiba, Japan

[21] Appl. No.: 684,244

[22] Filed: Dec. 20, 1984

[30] Foreign Application Priority Data

Dec. 26, 1983 [JP] Japan ..... 58-247917

[51] Int. Cl.[4] ..... F25B 9/00

[52] U.S. Cl. ..... 62/6; 60/520

[58] Field of Search ..... 62/6; 60/520

[56] References Cited

U.S. PATENT DOCUMENTS 3,312,239 4/1967 Chellis ..... 62/6
3,625,015 12/1971 Chellis ..... 62/6
3,656,313 4/1972 Low et al. ..... 62/6
3,733,837 5/1973 Lobb ..... 62/6
4,438,631 3/1984 Sarcia ..... 62/6

*Primary Examiner*—Ronald C. Capossela
*Attorney, Agent, or Firm*—Robert E. Burns; Emmanuel J. Lobato; Bruce L. Adams

[57] ABSTRACT

A refrigerator comprising a piston which is driven in a reciprocating fashion within a cylinder by the difference in pressure of working gas alternately supplied to first and second variable-volume chambers separated by said piston, a motor, a rotary valve which is attached to an output shaft of said motor and which switches a passageway for said working gas provided between said first and second variable-volume chambers alternately to a high-pressure supply side and low-pressure return side, and at the same time blocks said passageway, and a cam which is mounted on an output shaft of said motor and which guides the reciprocation of said piston in accordance with the motion of said rotary valve connected to said piston rod.

14 Claims, 12 Drawing Figures

(PRIOR ART)

GAS REFRIGERATOR

FIG. 1 schematically shows a conventional motor-driven gas refrigerator. Within an expander 1, a piston 3 is reciprocated in a cylinder 4 by a crankshaft 2 rotated by a motor. The cylinder 4 is divided by the piston 3 to form a room-temperature chamber 5 in the upper end thereof and an expansion chamber 6 in the lower end. A regenerator 7 and a heat exchanger 8 are provided in series between the room-temperature chamber 5 and the expansion chamber 6.

A compressor 9 is provided with a high-pressure valve 10 and a low-pressure valve 11 consisting of poppet valves in a high-pressure supply passageway and a low-pressure return passageway, respectively, and the discharge side of the valve 10 and the inlet side of the valve 11 are connected to the point at which the room-temperature chamber 5 is connected to the regenerator 7. The valves 10, 11 are opened and closed by the driving force of the motor.

This kind of motor-driven refrigerator has an ideal refrigeration cycle as shown in FIG. 2(*a*).

At a start point A of the refrigeration cycle, the piston 3 is at the lowest part of the cylinder 4, so that the room-temperature chamber 5 has a maximum volume and the expansion room 6 has a minimum volume. When the valve 11 closes and the valve 10 opens in this state, high-pressure gas is charged into the chambers 5, 6 from the compressor 9, and the pressure within the cylinder 4 becomes a predetermined high pressure. Since the volume of the expansion chamber 6 is at a minimum and is constant, the cycle moves to point B immediately above point A.

The piston 3 then moves upward, and as the size of the room-temperature chamber 5 is reduced and that of the expansion chamber 6 is enlarged, the high-pressure gas in the room-temperature chamber 5 is transferred to the expansion chamber 6, while being cooled by the regenerator 7. During this time, the pressure within the expansion chamber 6 is kept constant, so that the cycle moves horizontally to point C from point B.

When the piston 3 reaches the uppermost part of the cylinder 4 and the volume of the expansion chamber 6 is at a maximum, at point C, the valve 10 closes and the valve 11 opens, so that the high-pressure gas in the expansion chamber 6 rapidly returns to the low-pressure side of the compressor 9 through the heat exchanger 8 and the regenerator 7. During this time, cooling is produced by the adiabatic expansion of the gas, so that a refrigeration output is obtained from the heat exchanger 8, and the pressure within the expansion chamber 6 becomes at a minimum. This rapid reduction of pressure transfers the cycle from point C to point D, directly under point C.

When the piston 3 moves downward, the low-pressure expanded gas whose temperature has dropped returns to the low-pressure side of the compressor 9, while cooling the regenerator 7. Since the pressure within the expansion chamber 6 remains at a constant low level, the cycle moves horizontally from point D back to point A.

In short, the ideal refrigeration cycle forms a rectangle on a P–V graph.

However, in actual practice the P–V graph is as shown in FIG. 2(*b*). It is inevitable that the points of the corner at the start point A and at the third corner of the third point C of the ideal cycle are removed, as shown by A′, C′, because the two valves cannot be switched over simultaneously. In addition, since the reciprocating motion of the piston is continuous, the piston starts to move up or down before the pressure within the expansion chamber reaches the predetermined maximum or minimum pressure. Therefore the volume of the expansion chamber changes earlier, and the portions of the ideal cycle corresponding to the sides a, c both incline inwardly and become a′, c′. Consequently the area drawn or circumscribed by one cycle is smaller as a whole, which leads to a reduction in the limiting value of the refrigeration capacity.

Furthermore, in this kind of motor-driven refrigerator, the power of the motor must be increased because the piston is driven and the valves are switched over by the motor. Another drawback is that the valves are poppet valves which have a complicated structure and are difficult to maintain.

Conventional gas-driven refrigerators are schematically shown in FIGS. 3 and 4. In each of these refrigerators, a piston is driven by a working gas. The same reference marks denote the same or similar parts as those in FIG. 1, and thus a repeated description thereof is omitted.

In the refrigerator of FIG. 3, a high-pressure chamber $V_1$ and a low-pressure chamber $V_2$ are provided in the upper part of a cylinder 32 of an expander 31 and the chambers are connected to the high-pressure side and the low-pressure side of the compressor 9 by orifices 33, 34, respectively. The cross-sectional areas of the high-pressure chamber $V_1$ and the low-pressure chamber $V_2$ are made to be equal, and an intermediate pressure is always applied to the upper surface of a piston 35.

The operation of this refrigerator will be briefly described. When the piston 35 is at the lower end of the cylinder 32, the valve 10 opens and the valve 11 closes, so that high-pressure gas is supplied to the expansion chamber 6 while being cooled by the regenerator 7.

When the pressure within the expansion chamber 6 exceeds the intermediate pressure, the piston 35 starts to rise, and moves toward the upper end of the cylinder 32 at a constant velocity in proportion to the quantity of gas which passes through the orifices 33, 34.

When the piston 35 reaches the upper end of the cylinder 32, the valve 10 closes and the valve 11 opens. Adiabatic expansion of the gas in the expansion chamber 6 produces cooling. When the pressure in the expansion chamber 6 drops below the intermediate pressure, the piston 35 moves downward.

The adiabatically expanded gas which has cooled is driven out of the expansion chamber 6 with the downstroke of the piston 35, and returns to the low-pressure side of the compressor 9 while cooling the regenerator.

The piston 35 reaches the lowest part of the cylinder 32 to finish the cycle.

In the refrigerator of FIG. 4, two pressure chambers $V_1$ and $V_2$ communicating with each other through an orifice 43 are provided in the upper part of a cylinder 42 of an expander 41. High-pressure gas from the compressor 9 is supplied to the pressure chamber $V_1$ through an orifice 44, and high- or low-pressure gas is supplied thereto through an orifice 45 so that, at the beginning of the cycle, gas of an intermediate pressure between high and low is supplied to the pressure chamber $V_2$.

The operation of this refrigerator will be briefly described below. At the start of the cycle, a piston 46 is in the lowest part of the cylinder 42, and the pressure within the pressure chamber $V_2$ is at an intermediate value. When the valve 10 is opened, high-pressure gas is supplied to the expansion chamber 6 while being cooled by the regenerator 7. When the pressure within the expansion chamber 6 exceeds the intermediate pressure, the piston moves upward, compressing the gas in the pressure chamber $V_2$ to high-pressure gas. As the high pressure gas in the pressure chamber $V_2$ passes through the orifice 43 to the pressure chamber $V_1$, the piston 46 rises at a constant speed.

When the piston 46 gets to top dead center, the valve 11 closes and the valve 10 opens. The gas in the expansion chamber 6 expands adiabatically to produce cooling.

When the pressure within the pressure chamber 6 falls, the high-pressure gas in the pressure chamber $V_1$ enters the pressure chamber $V_2$, and pushes the piston 46 downward. This drives the low-temperature gas in the expansion chamber 6 out to the low-pressure side of the compressor 9 while cooling the regenerator 7.

The piston 46 reaches the lowest part of the cylinder 42 to finish the cycle.

The curve of the ideal cycle of this kind of gas-driven refrigerator on a P–V graph is, as is obvious from the description of the operation, as shown in FIG. 5(*a*). Point $B_1$ indicates the intermediate pressure point.

However, the P–V graph obtained in actual practice is as shown in FIG. 5(*b*). As stated in connection with FIG. 2(*b*), the corners of the parts corresponding to the points A, C are removed to form A′ and C′, and the part corresponding to the side c inclines inward to form the side c′. This is because the gas in the expansion chamber 6 expands adiabatically so that the pressure drops to less than the intermediate pressure, and the piston moves downward before the pressure reaches the predetermined minimum pressure, so that the volume of the expansion chamber changes earlier. As a result, the area drawn by or circumscribed one cycle is reduced.

A drawback of this gas-driven refrigerator is that the piston cannot be accurately controlled to stop at top dead center and bottom dead center, so that the upper or lower end of the piston hits the cylinder, generating large quantities of vibration and noise. To prevent this, in the present state of the art, cushioning is provided within the cylinder.

OBJECT OF THE INVENTION

Accordingly an object of the present invention is to eliminate the drawback of the piston hitting the cylinder, while keeping the advantages of the gas-driven refrigerator, and make the refrigeration cycle thereof closer to the ideal curve on a P–V graph of a motor-driven refrigerator.

SUMMARY OF THE INVENTION

To this end, this invention provides a gas-driven refrigerator provided with a piston which is driven in a reciprocating fashion within a cylinder by the difference in pressure of a working gas alternately supplied to first and variable-volume second chambers separated by the piston, a motor, a rotary valve attached to an output shaft of the motor and which switches a passageway for the working gas provided between the first and second variable-volume chambers alternately to a high-pressure supply side and low-pressure return side, and at the same time blocks the other passageway, and a cam mounted on the output shaft of the motor and which guides the reciprocation of the piston in accordance with the motion of the rotary valve attached to the piston rod.

DESCRIPTION OF THE PREFERRED EMBODIMENT

Figure 6:
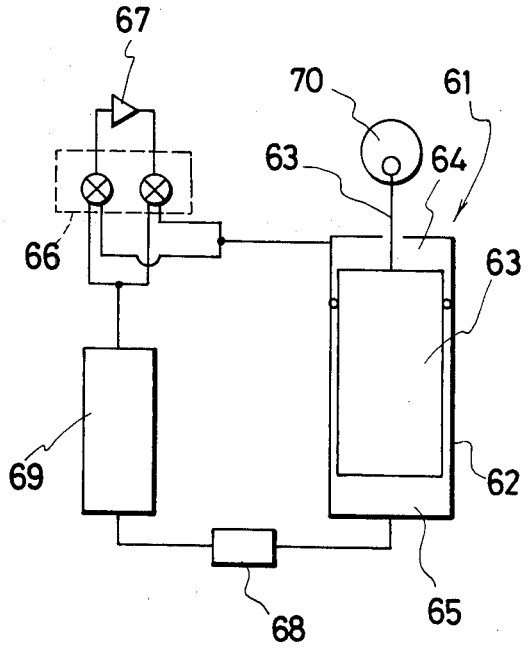
FIG. 6 is a block diagram of an embodiment of refrigerator according to the present invention.

FIG. 6 is a block diagram of the fundamental structure of an embodiment of a gas refrigerator according to the present invention.

A drive chamber 64 and an expansion chamber 65 are formed in an expander 61 separated by a piston 63 which moves reciprocatingly in a cylinder 62. The drive chamber 64 is connected to high- and low-pressure sides of a compressor 67 by a rotary valve 66. The expansion chamber 65 is connected to the low-pressure side and the high-pressure side of the compressor 67 through a heat exchanger 68 and a regenerator 69. The difference in pressure between the drive chamber 64 and the expansion chamber 65 moves the piston 63 reciprocatingly in the cylinder 62, and this reciprocation is guided by a cam 70.

Figure 7:
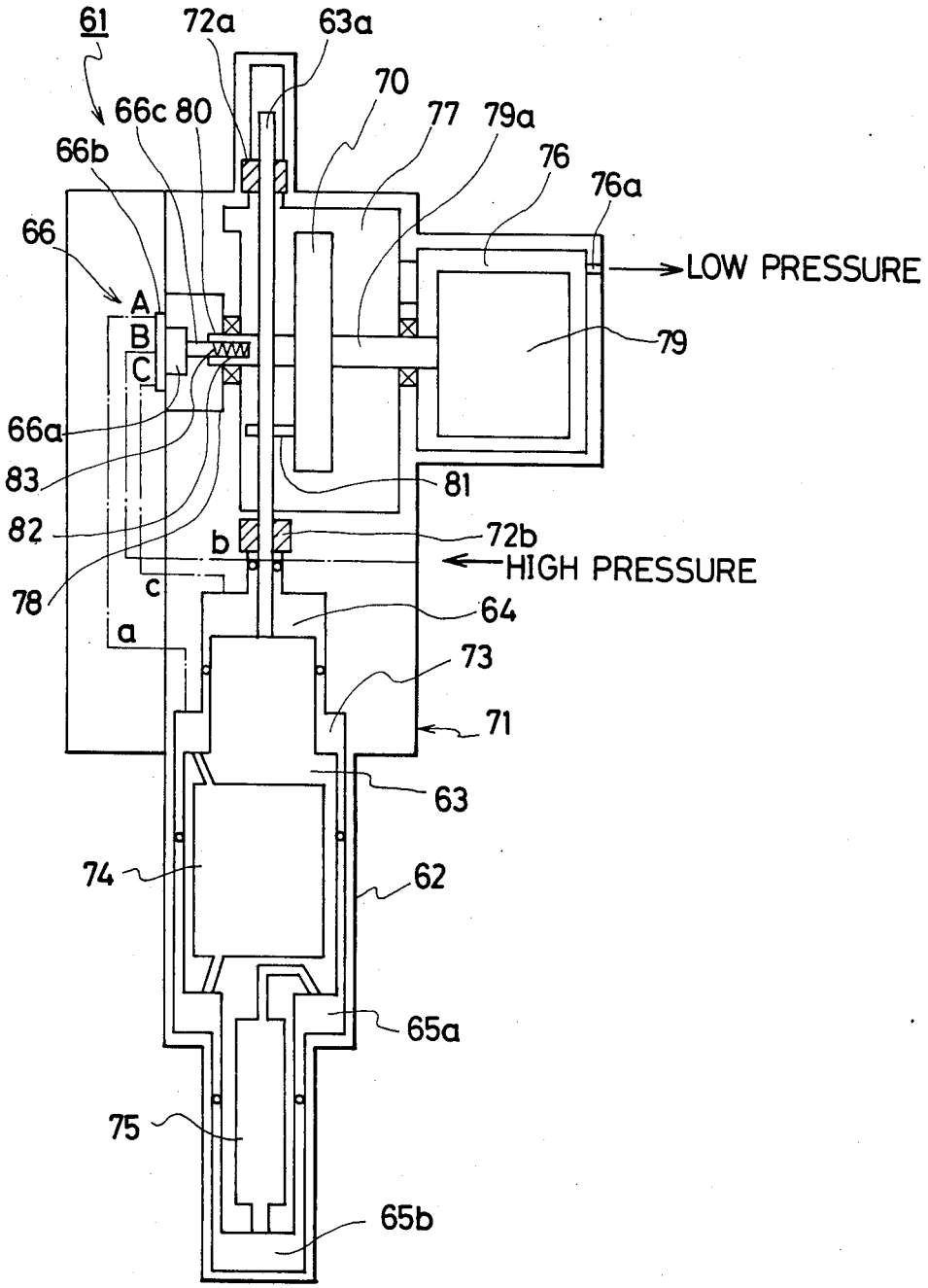
FIG. 7 is a lateral section through the expansion chambers of the embodiment of FIG. 6.

The expander 61 has a structure as shown in FIG. 7. In FIG. 7, the cylinder 62 is formed so as to protrude from the lower part of a main body 71, and a piston rod 63*a* of the piston 63 housed in the cylinder 62 is supported within the upper part of the main body 71 by two bearings 72*a*, 72*b* so that it can move vertically.

The drive chamber 64 is provided in the upper end of the upper part of the cylinder 62, and an intermediate chamber 73 is provided therein one step lower than the cylinder. A first expansion chamber 65*a* is provided in an intermediate part of the lower part of the cylinder 62, and a second expansion chamber 65*b* is provided in the lowermost part thereof. A first regeneration chamber 74 is formed within an intermediate part of the piston 63, and a second regeneration chamber 75 within the lowest part thereof. The second regeneration chamber 75 connects the first expansion chamber 65*a* and the second expansion chamber 65*b*. Regeneration material composed of mesh or particles of a metal such as copper or iron is housed in the first and second regeneration chambers 74, 75, and acts as the regenerator 69.

A motor chamber 76, a cam chamber 77, and a valve chamber 78 are formed in a horizontal line in that order from right to left in the upper part of the main body 71. These chambers are connected to each other, and are also connected to the low-pressure side of the compressor 67 through a hole 76*a* in the wall of the motor chamber 76.

An output shaft 79*a* of a motor 79 projects into the cam chamber 77, and the cam 70 is fixed to the end thereof. The lead surface of the cam 70 faces the piston rod 63*a* which moves vertically through the cam chamber 77, and a cam follower 81 projecting from the piston rod 63*a* slides along the cam lead surface. A cam shaft 80 projects from the cam lead surface of the cam 70, on the same axis as the output shaft 79*a*, and its end faces the valve chamber 78. An engagement notch 82 is formed in the end of the cam shaft 80.

Figure 8:
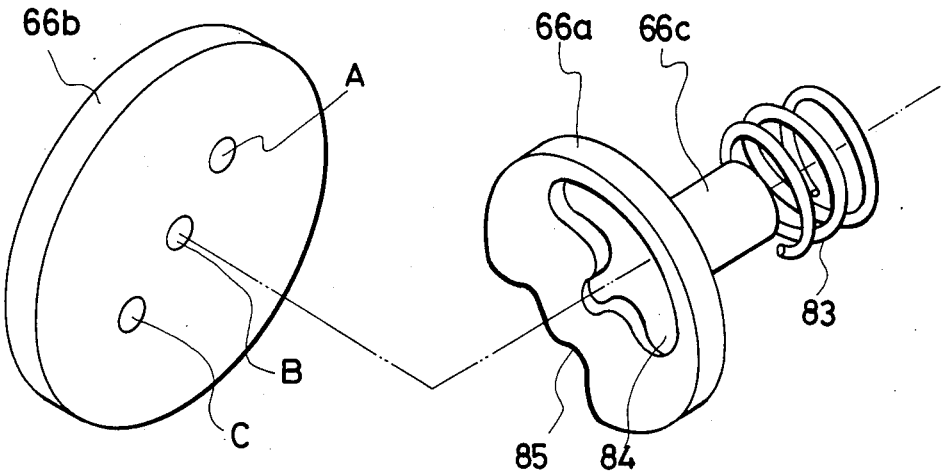
FIG. 8 is an exploded perspective view of the rotary valve thereof.

A rotary valve 66 provided in the valve chamber 78 is composed of a valve 66*a* with a shaft portion 66*c* which is inserted into the engagement notch 82 and is supported by the cam shaft 80, and a valve seat 66*b* mounted on the side wall of the valve chamber 78. The shaft portion 66*c* is urged constantly outward by a spring 83 inserted into the engagement notch 82, so that the valve 66*a* rotates while pressed against the side surface of the valve seat 66*b*, linked to the rotation of the cam 70. The valve seat 66*b* and the valve 66*a* are illustrated in detail in FIG. 8. Three ports A, B and C are provided in the valve seat 66*b*. Port B in the center is connected to a passageway b which leads to the high-pressure side of the compressor 67, and ports A, C on the right and left sides thereof are connected passageways a, c which lead to the intermediate chamber 73 and the drive chamber 64, respectively. A slot 84 is formed in the upper half of the valve 66*a*, and a notch 85 in the lower half thereof. When the valve 66*a* rotates, together with the rotation of the cam 70, the slot 84 can connect port B to port A, and the notch 85 can connect port C with the low-pressure side of the compressor 67. Depending on the rotational position of the slot 84, port B can be disconnected from both port A and port C.

Figure 9:
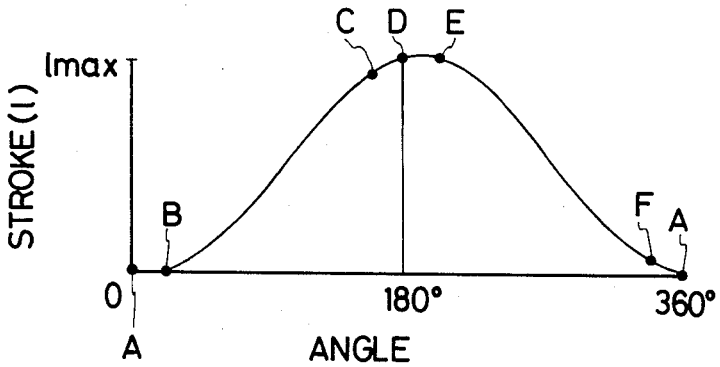
FIG. 9 is a graph of the displacement of the cam lead; surface.

The operation of the refrigerator according to the present invention will now be described with reference to FIGS. 9 and 10. At the start point A of the refrigeration cycle, the piston 63 is at bottom dead center, and the angle of displacement of the cam lead surface is 0°. When the cam 70 rotates slightly from this position, the rotary valve 66 connects passageways b and a, and thus connects the intermediate chamber 73 to the high-pressure side and the drive chamber 64 to the low-pressure side. The high-pressure gas supplied to the intermediate chamber 73 enters the first expansion chamber 65*a* while being cooled as it passes through the first regeneration chamber 74, and the high-pressure gas supplied to the first expansion chamber 65*a* enters the second expansion chamber 65*b* while being cooled in the second regeneration chamber 75. As a result, the pressure within the first and second expansion chambers 65*a* and 65*b* increases. However, as the cam 70 continues to rotate, the piston 63 remains at bottom dead center because of the engagement of the cam follower 81 with the cam lead surface, until the displacement angle of the cam lead surface reaches point B. This increases the pressure within the first and second expansion chambers 65*a* and 65*b* vertically from the value at the start point A to a predetermined value at point B. As the cam 70 rotates further and the displacement angle of the cam lead passes point B, the piston 63 starts to move upward, pushed by the pressure within the first and second expansion chambers 65*a*, 65*b*. During this upstroke, the upward speed is regulated by the engagement of the cam follower 81 with the cam lead surface. Accordingly the volumes of the first and second expansion chambers 65*a*, 65*b*, increase successively, but the continuing supply of high-pressure gas keep the pressure therein constant, and the cycle moves horizontally from point B to point C along the line in the P–V graph.

As the piston 63 rises and immediately before it reaches top dead center, i.e. beginning at point C, the connection of port B and port A is cut off by the rotary displacement of the slot 84. This means that since the supply of high-pressure gas to the first and second expansion chambers 65*a*, 65*b* is cut off, the pressure therein drops. At the same time, the connection between port C and the low-pressure side of the compressor 67 is cut off, so that the discharge of low-pressure gas from the drive chamber 64 stops and the pressure therein rises. As a result, the upward speed of the piston 63 decreases. Therefore the cycle moves diagonally from point C downward to point D in the P–V graph.

At point D, when the piston reaches top dead center, the rotary valve 66 switches over to connect passageways b and c to supply gas to the drive chamber 64, and connect the intermediate chamber 63 to the low-pressure side. However, when the angle of displacement of the cam lead surface reaches 180°, the piston 63 is made to stay at top dead center because of the engagement between the cam follower 81 and the cam lead. This state is maintained until the angle of displacement of the cam lead exceeds 180°, namely at point E. Since at point D the high-pressure compressed gas in the first and the second expansion chambers 65*a* and 65*b* is rapidly passed to the low-pressure side, the pressure drops suddenly and the gas expands adiabatically to produce cooling. This action is illustrated on the P–V graph of FIG. 10 as the vertically-downward movement from point D to point E.

As the cam 70 continues to rotate further and the angle of displacement of the cam lead surface passes point D, the piston 63 starts to move downward. Its downward speed during this time is regulated by the engagement between the cam follower 81 and the cam lead surface. The volumes of the first and second expansion chambers 65*a*, 65*b* are reduced for a short time while the predetermined low-pressure state is held. When the piston 63 reaches a point immediately before the bottom dead center, beginning at point F, the rotary valve 66 cuts off the connection between passageways b and c, and the connection between the passageway a and the low-pressure side of the compressor 67, to stop the supply of high-pressure gas to the drive chamber 64 and the discharge of low-pressure gas from the first and second expansion chambers 65*a*, 65*b*, which reduces the downward speed of the piston 63.

In this way, the piston 63 decelerates as it approaches bottom dead center and the cam 70 finishes rotating through 360° to return to the start point A, ending the cycle.

As is obvious from the above description, during its reciprocation, the piston 63 is precisely controlled to stop at top dead center and bottom dead center, which prevents the piston 63 from hitting the end walls of the cylinder 62.

In addition, since the motor 79 is only required to drive the cam 70 and the rotary valve 66, a very low-power motor can be used.

Figure 1:
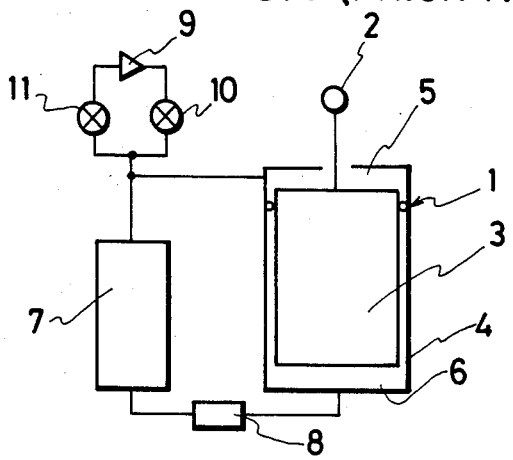
FIG. 1 (PRIOR ART)
FIG. 1 is a block diagram of a conventional motor-driven refrigerator.
Figure 2A:
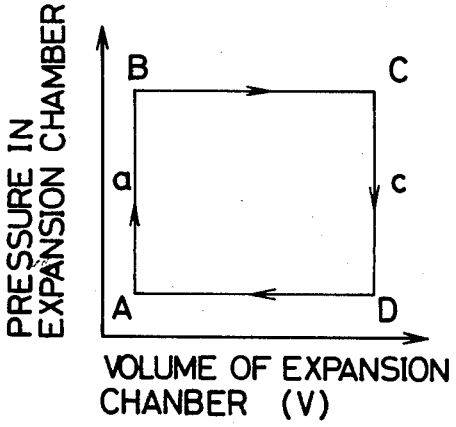
FIG. 2(a) (PRIOR ART)
FIGS. 2(*a*) and 2(*b*) are P–V graphs of the refrigerator of FIG. 1, in which FIG. 2(*a*) shows the ideal cycle and FIG. 2(*b*) the cycle obtained in practice.
Figure 2B:
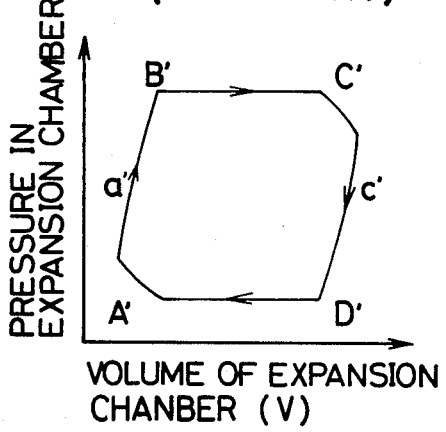
FIG. 2(b) (PRIOR ART)
Figure 3:
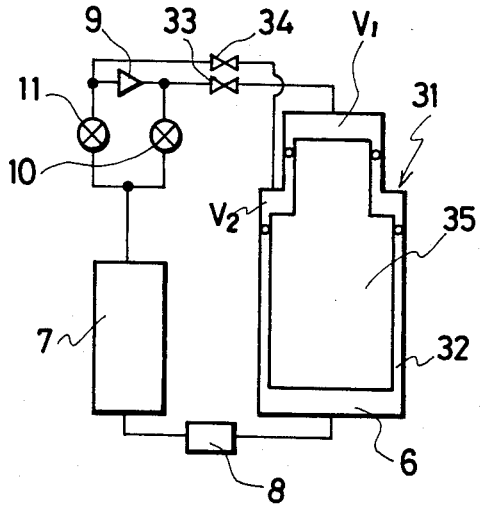
FIGS. 3 and 4 are block diagrams of conventional gas-driven refrigerators.
Figure 4:
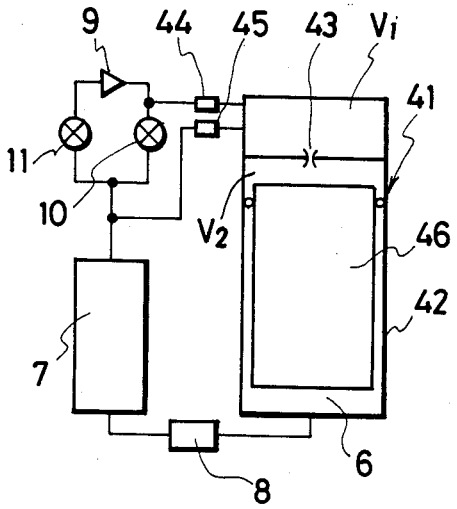
(PRIOR ART) FIG. 4
Figure 5A:
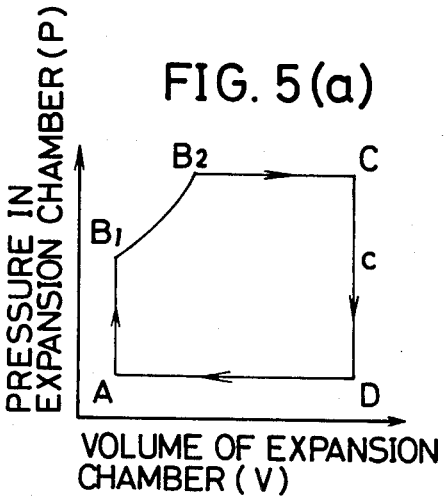
(PRIOR ART) FIG. 5(a)
FIGS. 5(*a*) and 5(*b*) are P–V graphs of the refrigerators shown in FIGS. 3 and 4, in which FIG. 5(*a*) shows the ideal cycle and FIG. 5(*b*) the curve obtained in practice.
Figure 5B:
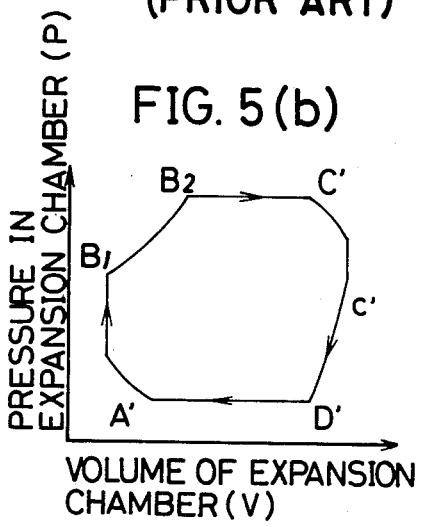
(PRIOR ART) FIG. 5(b)
Figure 10:
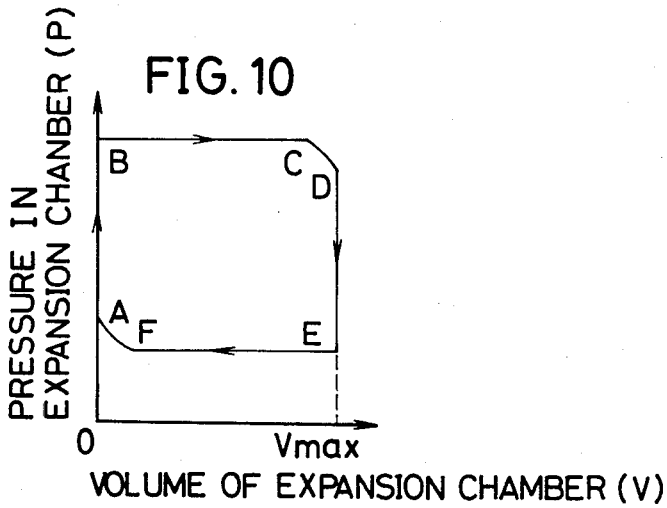
FIG. 10 is the P–V graph obtained in practice by the embodiment of FIG. 6.

The cycle in the P–C graph of FIG. 10 is very close to the ideal one in the P–V graph of the motor-driven refrigerator shown in FIG. 2(*a*). This means that the limiting value of refrigeration capacity can be increased.

EFFECTS OF THE INVENTION

The present invention makes it possible to produce a refrigeration cycle which is close to the ideal one, increase the refrigeration capacity, and thus reduce the refrigeration time. Since the piston does not strike the cylinder at the end of its strokes, vibration and noise are greatly reduced. In addition, since the motor drives only a cam and a rotary valve, a very low-power motor can be used therefor. The simple structure of the rotary valve also facilitates maintenance.

We claim:

1. A gas refrigerator comprising:

a cylinder having slidably mounted therein a piston which divides the cylinder into first and second variable volume chambers disposed on opposite sides of the piston;

passageway means for alternately supplying high and/or low pressure working gas to said first and second variable volume chambers so as to effect reciprocation of the piston in the cylinder in response to the difference in pressure of the working gas in said first and second chambers;

valve means operative when driven to switch a passageway for the working gas provided between said first and second variable volume chambers alternately to a high-pressure supply side and a low-pressure return side to thereby alternately supply high and low pressure working gas to said first and second chambers;

a movable cam operative when driven to guide the reciprocation of said piston in synchronization with the motion of said valve means to control the stroke and/or speed of the piston so as to reduce the speed of the piston in the regions adjacent its top and bottom dead centers; and driving means for driving the cam and the valve means in synchronism.

2. A gas refrigerator as claimed in claim 1; wherein the valve means includes means for periodically disconnecting both the first and second variable volume chambers from both the high and low pressure sides.

3. A gas refrigerator as claimed in claim 2; wherein the valve means includes means for effecting the said disconnection when the piston is adjacent either of its dead centers.

4. A gas refreigerator as claimed in claim 1; wherein the driving means comprise a motor for rotationally driving both the cam and the valve means.

5. A gas refrigerator as claimed in claim 4; wherein the cam is mounted on an output shaft of the motor, and the valve means comprises a valve member connected to the output shaft so as to be driven thereby.

6. A gas refrigerator as claimed in claim 5; wherein the valve member has a shaft portion mounted in a notch in an end of the said output shaft.

7. A gas refrigerator as claimed in claim 1; wherein the hight and low pressure sides comprise the high and low pressure sides of a common compressor.

8. A gas refrigerator as claimed in claim 1; wherein the second variable volume chamber comprises first and second expansion chambers which communicate with each other, and an intermediate chamber which communicates with the second variable volume chamber.

9. A gas refrigerator as claimed in claim 8; wherein the intermediate chamber is defined between the piston and the cylinder.

10. A gas refrigerator as claimed in claim 1; wherein the passageway means comprises a first passageway extending between the second variable volume chamber and the said valve means, a second passageway which extends from one of the high or low pressure sides to the valve means, a third passageway which extends from the first variable volume chamber to the valve means, and a fourth passageway which extends from the valve means to the other of the high or low pressure sides.

11. A gas refrigerator as claimed in claim 10; including means interconnecting the cam and the valve means such that when the cam has moved slightly beyond the position in which the piston is at a predetermined dead center, the valve means interconnects the first and second passageways and also interconnects the third and fourth passageways, but the piston is initially retained at the said predetermined dead center by the cam and thereafter moves towards the other dead center under the control of the cam.

12. A gas refrigerator as claimed in claim 11; wherein the interconnecting means has means for causing the valve means to cut off the interconnection between the first and second passageways and to cut off the interconnection between the third and fourth passageways immediately before the piston reaches the said other dead center.

13. A gas refrigerator as claimed in claim 12; wherein the interconnecting means has means for causing the valve means to switch over to interconnect the second and third passageways and to interconnect the first and fourth passageways when the piston reaches the said other dead center, but the piston is initially retained at the said other dead center by the cam and thereafter moves towards the said predetermined dead center under the control of the cam.

14. A gas refrigerator as claimed in claim 13; wherein the interconnecting means has means for causing the valve means to cut off the connection between the second and third passageways and to cut off the connection between the first and fourth passageways immediately before the piston reaches the said predetermined dead center.

* * * * *